US009283664B2

(12) United States Patent
Clemetson et al.

(10) Patent No.: US 9,283,664 B2
(45) Date of Patent: Mar. 15, 2016

(54) RIGHT-ANGLE BRAKE TOOL

(71) Applicants: Abraham A. Clemetson, Brooklyn, NY (US); Laurence W. Legall, Brooklyn, NY (US)

(72) Inventors: Abraham A. Clemetson, Brooklyn, NY (US); Laurence W. Legall, Brooklyn, NY (US)

(73) Assignee: NEXX LEVEL HOLDINGS INTERNATIONAL, LLC, Brooklyn, NY (US)

( * ) Notice: Subject to any disclaimer, the term of this patent is extended or adjusted under 35 U.S.C. 154(b) by 309 days.

(21) Appl. No.: 13/838,396

(22) Filed: Mar. 15, 2013

(65) Prior Publication Data

US 2013/0333177 A1 Dec. 19, 2013

Related U.S. Application Data

(60) Provisional application No. 61/660,534, filed on Jun. 15, 2012.

(51) Int. Cl.

| | |
|---|---|
| ***B25B 27/14*** | (2006.01) |
| ***B25B 27/00*** | (2006.01) |
| *B25B 27/30* | (2006.01) |

(52) U.S. Cl.

CPC ..... *B25B 27/14* (2013.01); *B25B 27/0035* (2013.01); *B25B 27/306* (2013.01); *B25B 27/30* (2013.01); *Y10T 29/49718* (2015.01); *Y10T 29/537* (2015.01); *Y10T 29/53613* (2015.01); *Y10T 29/53909* (2015.01); *Y10T 29/53991* (2015.01)

(58) Field of Classification Search

CPC ..... B25B 27/14; B25B 27/30; B25B 27/306; B25B 27/0035; Y10T 29/537; Y10T 29/53909; Y10T 29/53613; Y10T 29/53991; Y10T 29/49718

See application file for complete search history.

(56) References Cited

U.S. PATENT DOCUMENTS

| | | | | |
|---|---|---|---|---|
| 2,839,820 | A * | 6/1958 | Bates | 29/227 |
| D269,497 | S | 6/1983 | Rogowsky | |
| 5,165,154 | A | 11/1992 | Miller | |
| 5,507,083 | A * | 4/1996 | Redgrave et al. | 29/227 |
| 5,732,456 | A * | 3/1998 | Frey | 29/426.6 |
| 6,108,882 | A | 8/2000 | Hodgson | |
| D594,719 | S | 6/2009 | Birgl | |
| 7,676,896 | B1 | 3/2010 | Carscadden | |

* cited by examiner

*Primary Examiner* — Ryan J Walters
(74) *Attorney, Agent, or Firm* — Winston & Strawn LLP

(57) ABSTRACT

A brake tool for servicing an S-cam braking mechanism, including an essentially elongate member of generally uniform thickness and having gripping and engagement portions separated by a predetermined lateral distance; an elevation portion intermediate the gripping and engagement portions and having a predefined gripping angle relative to the gripping portion as well as a predetermined engagement angle relative to the engagement portion; wherein the engagement portion transitions into an engagement extent along a transition portion of predetermined length, with the transition portion having a predetermined transition angle relative to an engagement means defined at a distalmost portion of the transition portion, wherein the engagement means is configured and dimensioned to engage a return spring shaft of an S-cam braking mechanism.

20 Claims, 4 Drawing Sheets

RIGHT-ANGLE BRAKE TOOL

TECHNICAL FIELD

The invention is directed to a tool for servicing S-cam braking mechanisms. In particular, the invention is directed to an S-cam brake service tool that provides beneficial angular configurations for expedited maintenance of S-cam brakes and enhanced safety for brake technicians.

BACKGROUND

In the transportation sector, spring brake mechanisms are widely recognized as a safe and reliable means of stopping heavy trucks and large commercial vehicles (the terms "vehicle" and "truck" shall be used interchangeably herein). Spring brakes use compressed air to make the brakes work: they are applied when air pressure is released, and disengaged when air pressure is supplied. Generally, a brake drum mechanism of a truck or equivalent spring brake vehicle is fixed on an axle for synchronous rotation, as depicted in FIG. 1.

FIG. 1 shows a conventional S-cam braking mechanism 10 mounted relative to axle 12. A pair of oppositely positioned brake shoes 14 is provided wherein each shoe is typically a steel mechanism with a lining 16 that causes friction against a brake drum 18. Brake shoes 14 have hook holes bored therein (not shown) to accommodate attachment of a stiff return spring 20 thereto. A pair of cam rollers 22 is provided for cooperation with an S-shaped cam ("S-cam") 24 that pushes brake shoes 14 apart and against brake drum 18 during a braking operation. Return spring 20 connected to each brake shoe 14 returns the shoes to an open position when not spread by the S-cam (or, alternatively, a diaphragm, not shown). A brake chamber 26 is provided as a generally cylindrical container that houses a slack adjuster 28. Slack adjuster 28 connects a push rod 30 to S-cam 24 for adjustment of a distance between the brake shoes, wherein such adjustment moves S-cam 24. Upon extension of push rod 30, the brakes are applied. Upon release of push rod 30, the brakes are released.

Spring brakes were designed so there would always be a fail-safe method of stopping an air brake vehicle, if for some reason, all air supply pressure were suddenly lost while the vehicle is in motion. This forms an emergency brake action to stop a vehicle in motion should the air supply fail. A parking brake valve (for instance, on the cab dash) releases the air pressure in the spring brake chambers, and the powerful spring applies hundreds of pounds of brake force on the push rod, thereby actuating the slack adjuster and setting the brakes.

When the brakes are used, the brake shoes force the brake linings to move outward and press the inner sides of the brake drum and thus produce a great frictional force to reduce truck speed or stop the truck altogether. These brake linings will gradually degrade after repeated use, and the brake shoes must be replaced in order to maintain the function of the braking system and ensure safety of driving. During the course of brake maintenance, it becomes necessary to remove the return spring from the brake shoe, although elevated tension in the spring (as much as 2,500 lb) renders this task difficult and dangerous.

Tools relating to brake springs tend to focus on different methods of gripping the brake spring. Some tools provide ease of use and/or construction simplicity. Some brake tools use a simple V-shaped cut with which to push on the spring. This allows an unsecured hold on the spring that sometimes results in inadvertent release of the spring. Such a slip can be dangerous to the repair person. Improved tools combine modified V-shaped cuts or other solutions for removing brake springs.

One known brake tool for assisting brake technicians in the removal and installation of S-cam brake shoes is disclosed by U.S. Pat. No. 7,676,896 to Carscadden. Carscadden discloses a brake tool having an elongate shaft having an upper end with an elongated, tapered neck and a narrow, flattened stem at a distal end thereof. A C-shaped gripping member is attached to the stem and provided co-planar therewith for gripping of a return spring thereby. A technician uses the S-cam as a fulcrum for the shaft to thereby stretch the return spring as needed for removal and attachment during brake servicing.

Carscadden, like other prior art, does not address the need for brake technicians to not only have an efficient means of maintaining S-cam braking mechanisms but also for such technicians to do so reliably and safely. There exists a need to provide a tool for servicing the S-cam brake assembly in a reliable and secure manner, regardless of the support surface on which the brake assembly is mounted (i.e., on an axle, on a table or like support surface, etc.). Such a tool should be readily fabricated from commercially available materials and amenable for use with existing commercially available braking mechanisms. The present invention now satisfies these needs.

SUMMARY

According to an aspect of the invention, a brake tool for servicing a variety of S-cam braking mechanisms is provided. The brake tool comprises an essentially elongate member of generally uniform thickness and having opposed gripping and engagement portions separated by a predetermined lateral distance. An elevation portion intermediate the gripping and engagement portions and coextensive with the predetermined lateral distance has a predefined gripping angle relative to the gripping portion as well as a predetermined engagement angle relative to the engagement portion. The engagement portion includes a transition portion of predetermined length having a predetermined transition angle relative to an engagement means. The engagement means is defined at a distalmost portion of the transition portion for engagement of a return spring shaft of a braking mechanism.

According to another aspect of the invention, the engagement means for engaging the return spring shaft of a braking mechanism includes a forked head having a pair of tines joined by a bridge section. The tines have a predefined space therebetween for engaging the return spring shaft, such that the spring shaft abuts the bridge section and the tines support at least a spring coil of the return spring upon insertion of the brake tool through an aperture in a brake shoe (such as during servicing of the braking mechanism).

Another aspect of the invention relates to a method for servicing an S-cam braking mechanism, which comprises engaging a return spring shaft of an S-cam braking mechanism with the brake tool as described herein such that return spring shaft abuts the engagement extent; and applying pressure to the gripping portion of the brake tool during the engaging step such that a return spring is at least partially compressed for removal or insertion thereof relative to the braking mechanism.

When a technician applies pressure to the gripping portion, the brake tool utilizes the S-cam (or, alternatively, the brake shoe) as a fulcrum for release of the return spring from the brake shoe to which it is detachably connected as well a reinsertion of the spring when maintenance of the brake mechanism is completed. The technician can thereby safely and quickly remove and replace the return spring in a predictable and repeatable manner, thereby not only improving safety conditions for the technician but also substantially reducing the time required for maintenance of the braking mechanism.

The method further comprises disposing the gripping portion proximate a user of the tool and disposing the engagement extent proximate the return spring during the engaging and applying. The method also comprises engaging at least one corresponding aperture in the braking mechanism with at least one coil of the return spring having a hook integral therewith for this purpose.

Other aspects of the present invention will become readily apparent from the following detailed description.

BRIEF DESCRIPTION OF THE DRAWINGS

Further details of the invention become apparent in the following detailed description and appended drawings, wherein.

DETAILED DESCRIPTION

Figure 2:
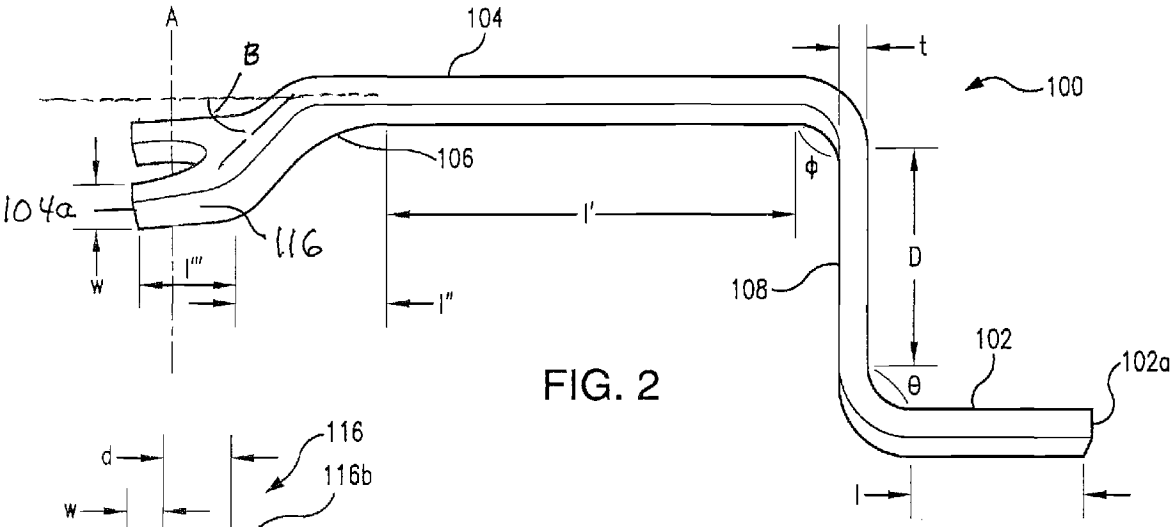
FIGS. 2 and 2A are perspective and sectional views, respectively, of an exemplary S-cam brake tool of the present invention.
Figure 2A:
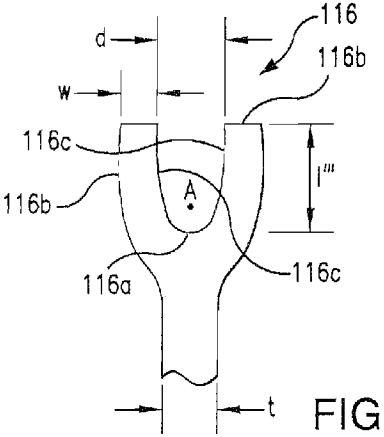

Now referring to the figures, wherein like numbers represent like elements, FIGS. 2 and 2A show an S-cam brake tool 100 of the present invention. Brake tool 100 comprises an essentially elongate member having a gripping portion 102 terminating in a gripping extent 102*a* and an engagement portion 104 terminating in an engagement extent 104*a*. Gripping extent 102*a* is a free extent disposed proximate a brake technician for ready handling of the tool thereby. Engagement extent 104*a* is a free extent disposed proximate an S-cam return spring during use, as will be further described herein.

The engagement portion 104 has a predetermined length that is greater than that of the gripping portion 102. Gripping portion 102 has a predetermined length l in a range of about 7"±1", and engagement portion 104 has a predetermined length l' in a range of about 9"±1". Engagement portion 104 transitions into engagement extent 104*a* along a transition portion 106 having a predetermined length" and a predetermined transition angle β. Transition length l" is provided in a range from about 1" to about 1.5" and more preferably in a range of about 1.25"±0.25". Transition angle β is provided in a range of about 45°±5° relative to an engagement means defined at a distalmost portion of transition portion 106, as will be further described herein.

Gripping portion 102 is displaced from engagement portion 104 by a predetermined lateral distance D that is coextensive with an elevation portion 108 intermediate the gripping and engagement portions. Lateral distance D is provided in a range from about 4" to about 7" and more preferably in a range of about 6"±0.5". Elevation portion 108 has a predefined gripping angle θ relative to gripping portion 102 and a predetermined engagement angle Φ relative to engagement portion 104. Gripping angle θ is provided in a range from about 75° to about 90" and more preferably in a range from about 75° to less than 90°. Engagement angle Φ is provided in a range from about 75° to about 105° and more preferably in a range of about 90°±5°.

These ranges of distances and angles provide a brake tool that is readily used with a variety of commercially available S-cam and equivalent braking mechanisms. It is understood, however, that these ranges can be adapted for custom braking mechanisms while retaining the operability of the present invention spring brake tool.

Brake tool 100 is desirably fabricated as a single member having a generally uniform thickness t therealong (i.e., at least through gripping portion 102, engagement portion 104 and elevation portion 108). The thickness is desirably in a range of about ¼"±¼". Brake tool 100 may be fabricated from 4140 cold-rolled steel alloy, although it is understood that the tool may be fabricated from any metal, composite and any other material (or combination thereof) amenable to use of the tool as intended. It is also understood that although brake tool 100 is desirably fabricated as a single member, it may comprise two or more connectable members wherein connection is facilitated by known securement means.

An exemplary engagement means is shown as a forked head 116 for engagement with a return spring shaft (such as shaft 408*a* of return spring 408 shown in FIGS. 3 to 5 and further described below). Forked head 116 has a bridge section 116*a* of predetermined extent from which tines 116*b* depend generally in parallel relative to one another. Each tine 116*b* has an inner surface 116*c* separable from an adjacent tine inner surface 116*c* by a predetermined distance d, which distance may be less than, equal to, or greater than the extent of bridge section 116*a* (which extent is about equivalent to thickness t). Each tine 116*b* has a predetermined length l'" and a predetermined width w such that engagement of a return spring shaft at engagement extent 104*a* always facilitates pivotable and rotational movement of brake tool 100 relative to an axis A during the tool's operation. Tine length l'" is provided in a range from about ½" to about 1", and tine width w is desirably in a range of about 5/16"±¼".

Although tines 116*b* are depicted as generally symmetrical linear members, it is understood that the engagement means may comprise any configuration amenable to engagement with all or a portion of a return spring and/or return spring shaft. Such configuration may not necessarily be symmetrical nor linear but will provide sufficient support for engagement and retention of the return spring for the duration of service by the technician. Forked head 116 is desirably co-fabricated with at least engagement portion 104, although it is understood that that the forked head may comprise a detachable member that is detachably secured with engagement portion 104 by any known securement means that is amenable to practice present invention.

Figure 1:
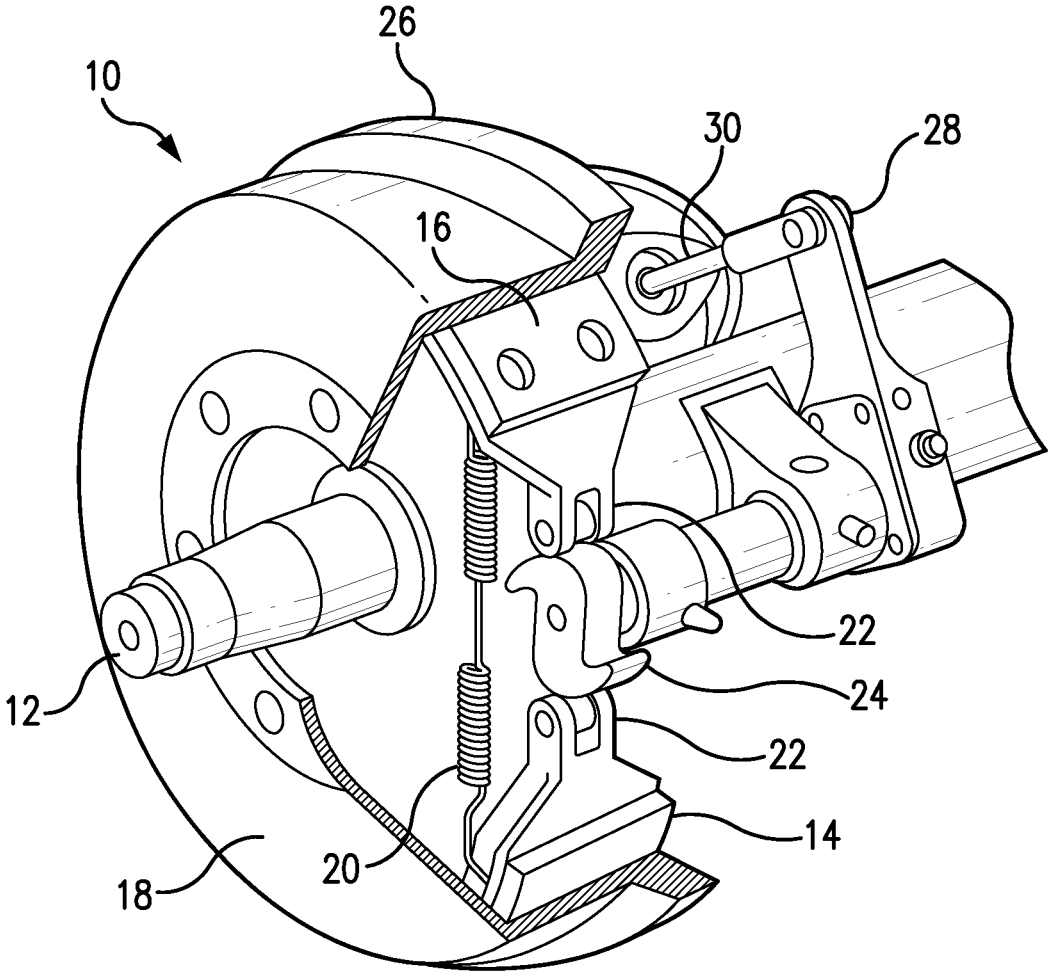
FIG. 1 PRIOR ART
FIG. 1 is a perspective cutout view of a conventional S-cam braking mechanism.
Figure 3:
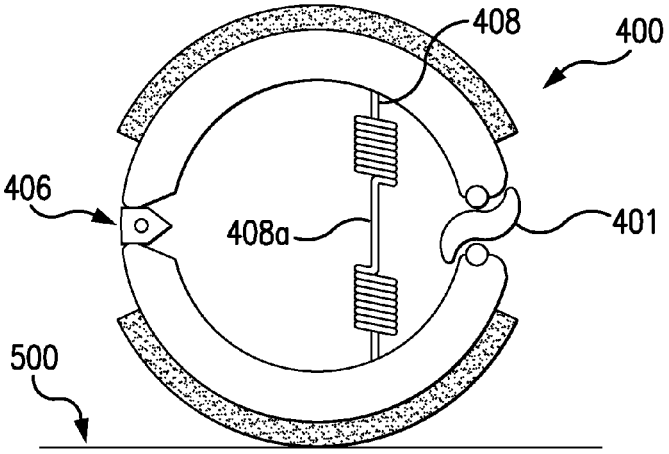
FIGS. 3 to 6 are perspective views of the S-cam brake tool of FIG. 2 in use with components of an S-cam braking mechanism.
Figure 4:
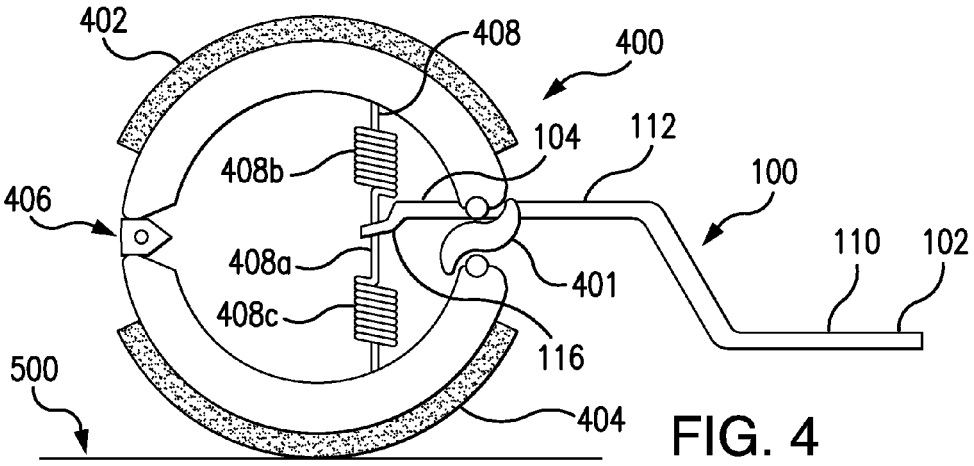
Figure 5:
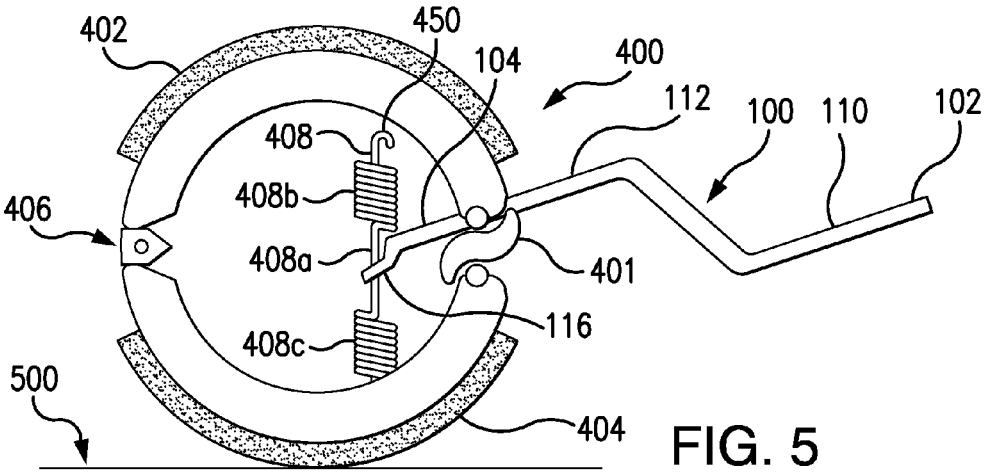

Now referring to FIGS. 3 to 5, brake tool 100 is shown in operation with a conventional S-cam braking mechanism 400 having an S-cam 401. Braking mechanism 400 may be of the type shown and described hereinabove with respect to FIG. 1. Referring to FIG. 3, braking mechanism 400 has been removed from a vehicle axle (not shown) and placed atop a servicing surface 500 (although it is understood that brake tool 100 is amenable for use with braking mechanism 400 when the braking mechanism remains attached to the vehicle axle). An upper brake shoe 402 and a lower brake shoe 404 are hingedly connected at a joining section 406 as is known in the art. A return spring 408 having a shaft 408*a* disposed between an upper coil 408*b* and a lower coil 408*c* attaches to each of upper brake shoe 402 and lower brake shoe 404, thereby ensuring tension therebetween. Attachment of the return spring is effected via a hook integral with each of upper coil 408*b* and 408*c* (such as hook 450 coextensive with upper coil 408*b*, shown in FIG. 5). Each hook is inserted into a corresponding hook hole in each brake shoe (as is known in the art and as described hereinabove with respect to FIG. 1). Referring to FIG. 4, engagement extent 104*a* of brake tool 100 is inserted through an aperture provided in upper brake shoe 402 such that forked head 116 (and particularly tines 116*b* thereof) engages return spring shaft 408 thereby. A technician, grasping gripping portion 102, inserts engagement extent 104*a* until return spring shaft 408*a* abuts bridge section 116*a* of forked head 116*a* and tines 116*b* support upper coil 408*b* thereby. Using upper brake shoe 402 as a fulcrum (with engagement portion providing lever means therefore), the technician applies pressure along gripping portion 102 so as to clear hook 450 from upper brake shoe 402 (see FIG. 5). The technician can thereby safely and quickly remove return spring 408 and immediately proceed to removal of the brake shoes and other corresponding service of braking mechanism 400 as is known in the art. To replace return spring 408, the technician again grasps gripping portion 102 and inserts engagement extent 104*a* through the aperture in upper brake shoe 402 so that forked head 116 engages return spring shaft 408*a*. Using the brake shoe as a fulcrum, the technician applies pressure along gripping portion 102, thereby enabling re-insertion of hook 450 and return of braking mechanism 400 to its original operational configuration.

Optionally, gripping portion 102 of brake tool 100 may be also used as a pry bar to install or remove the rollers of braking mechanism 400 (such as rollers 22 depicted in FIG. 1) and any associated locking clips (not shown).

Figure 6:
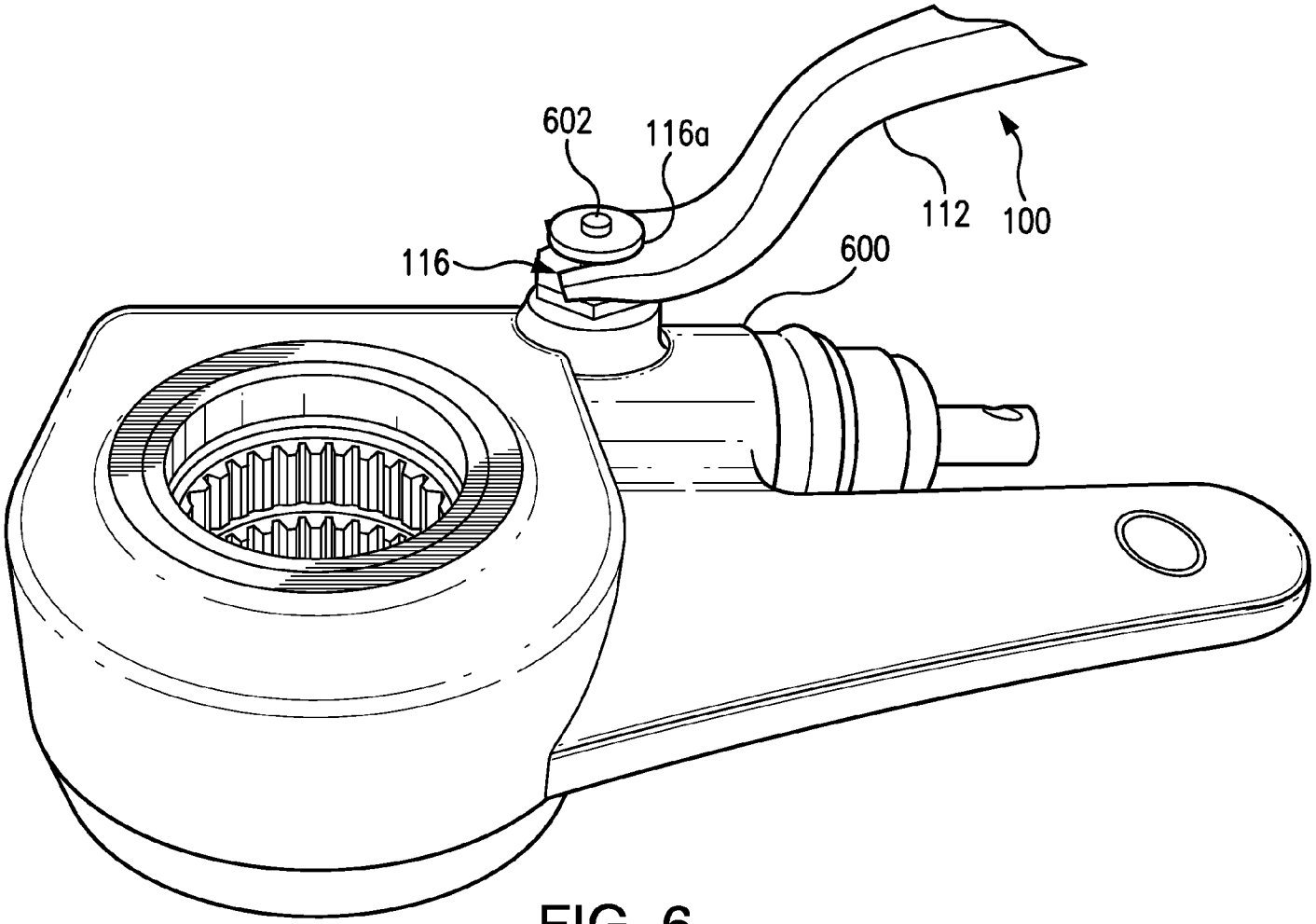

Brake tool 100 may optionally be used in servicing other elements of S-cam braking mechanism 400. FIG. 6 shows an exemplary use of brake tool 100 in adjusting a slack adjuster 600 which may be of the type shown and described hereinabove with respect to FIG. 1. As illustrated, brake tool 100 may be used to engage an adjusting nut 602 during brake adjustment such that forked head 116 receives a shaft portion (not shown) of adjusting nut 602 adjacent bridge section 116*a* and inner tine surfaces 116*c*. Upon rotation of brake tool 100, an S-cam in communication therewith will turn freely in the direction in which it would turn upon application of the brakes. When slack adjuster 600 is fully tightened, the brake shoes (not shown) are fully against the brake drums (not shown) and an associated pushrod will have a stroke commensurate with proper clearance between the brake shows and brake drums. Brake tool can also be used to remove and replace any associated locking clip (not shown) that acts as a safety clip, holding slack adjuster 600 onto the S-cam.

It is noted that the configuration of brake tool 100 permits servicing of S-cam brake assemblies on a variety of surfaces, including but not limited to work tables, axles and other support surfaces. The configuration of brake tool 100 also permits servicing of S-cam brake assemblies on vehicles, thereby saving technicians additional time. The present invention ensures adequate definition of a lever and fulcrum relative to the S-cam brake assembly to ensure predictable and repeatable removal and installation of the return spring among various brake assemblies. Such operation is desirably conducted a safe distance from the S-earn brake assembly to ensure the safety of the technician without sacrificing the efficiency of the brake service operation.

It is further noted that brake tool 100 is amenable to servicing multiple S-cam components as described and shown herein with respect to brake tool 100. One tool is amenable to the installation, removal, servicing and adjustment of one or more of brake springs, rollers, brake shows and drums, slack adjusters and locking clips without the need for additional tools. The disclosed brake tool therefore not only promotes technician safety but also optimizes the resources expended by technicians in monetary investments of tools and temporal investments of locating such tools for use in separate service procedures. A single tool can now be used for such procedures.

The dimensions and values disclosed herein are not to be understood as being strictly limited to the exact numerical values recited. Instead, unless otherwise specified, each such dimension is intended to mean both the recited value and a functionally equivalent range surrounding that value as well as equivalent units of that value. For example, a dimension disclosed as "40 mm" is intended to mean "about 40 mm" as well as "1.58 inches". In addition, the dimensions and values disclosed herein accommodate successful use of the present invention with a variety of commercially available S-cam braking mechanisms. The disclosure of such dimensions and values, however, shall not preclude use of the present invention tool with customized braking mechanisms having dimensions and values outside of the prescribed ranges.

Every document cited herein, including any cross-referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it is obvious to those skilled in the art that various changes can be made without departing from the spirit and scope of the invention. It is therefore intended to cover all such changes that are within the scope of this invention in the appended claims.

What is claimed is:

1. A brake tool for servicing an S-cam braking mechanism, comprising an essentially elongate member of generally uniform thickness and having a gripping portion and an engagement portion separated by a predetermined lateral distance; the engagement portion having a linear member, a distally extending transition portion of predetermined length and an engagement extent at a distal end thereof; an elevation portion intermediate the gripping and engagement portions and positioned at a predefined gripping angle relative to the gripping portion and at a predetermined engagement angle relative to the engagement portion; wherein the linear member of the engagement portion transitions into the engagement extent along the distally extending transition portion with the transition portion having a predetermined acute transition angle of about 45°±5° relative to the linear member of the engagement portion, with the engagement extent located at a distalmost portion of the transition portion and extending distally from the transition portion, wherein the engagement extent is configured and dimensioned as a U-shaped member for engaging a component of an S-cam braking mechanism.

2. The brake tool of claim 1, wherein the component comprises one of a return spring shaft, an adjustment nut of a slack adjuster, one or more brake rollers, one or more brake shoes, one or more brake drums or one or more locking clips.

3. The brake tool of claim 1, wherein the elevation portion is coextensive with the predetermined lateral distance.

4. The brake tool of claim 1, wherein the predetermined length of the transition portion is about 1" to about 1.5".

5. The brake tool of claim 1, wherein the engagement portion has a predetermined length that is greater than that of the gripping portion.

6. The brake tool of claim 5, wherein the predetermined length of the engagement portion is about 9"±1" and the predetermined length of the gripping portion is about 7"±1".

7. The brake tool of claim 1, wherein the predetermined lateral distance is in a range from about 4"to about 7".

8. The brake tool of claim 1, wherein the gripping angle is provided in a range from about 75° to about 90° and the engagement angle is provided in a range from about 75° to about 105°.

9. The brake tool of claim 1, wherein the U-shaped engagement extent of the engagement means comprises a forked head having a bridge section from which a pair of tines depend generally in parallel relative to one another, each tine having an inner surface separable from an adjacent tine inner surface by a predetermined distance, a predetermined length and a predetermined width such that engagement of the component at the engagement extent always facilitates pivotable and rotational movement of the brake tool.

10. The brake tool of claim 9, wherein the bridge section is coextensive with the thickness of the elongate member.

11. The brake tool of claim 9, wherein each tine has a length of from about ½" to about 1" and a width of about 5/16"±¼".

12. A method for servicing an S-cam braking mechanism, which comprises:

engaging a component of an S-cam braking mechanism with the brake tool according to claim 1; and applying pressure to the gripping portion of the brake tool during the engaging step to facilitate removal or insertion of the component relative to the braking mechanism.

13. The method of claim 12, wherein the component is a return spring shaft which is engaged to abut the engagement extent; and the pressure is applied to the gripping portion of the brake tool during the engaging step such that a return spring is at least partially compressed for removal or insertion thereof.

14. The method of claim 13, which further comprises disposing the gripping portion proximate a user of the tool and disposing the engagement extent proximate the return spring during the engaging and applying.

15. The method of claim 14, which further comprises inserting the brake tool through an aperture provided in at least a portion of the braking mechanism to effect the engaging step.

16. The method of claim 13, which further comprises engaging at least one corresponding aperture in the braking mechanism with at least one coil of the return spring having a hook integral therewith for this purpose.

17. The method of claim 13, wherein the U-shaped engagement extent of the engagement means of the brake tool comprises a forked head having a bridge section from which a pair of tines depend generally in parallel relative to one another, each tine having an inner surface separable from an adjacent tine inner surface by a predetermined distance, a predetermined length and a predetermined width such that engagement of the return spring shaft at the engagement extent always facilitates pivotable and rotational movement of the brake tool.

18. The method of claim 17, which further comprises abutting the return spring shaft against the bridge section of the forked head such that the tines support at least a portion of the return spring during the engaging step.

19. A brake tool for servicing an S-cam braking mechanism, comprising an essentially elongate member of generally uniform thickness and having a gripping portion and an engagement portion separated by a predetermined lateral distance; the engagement portion having a linear member, a distally extending transition portion of predetermined length and an engagement extent at a distal end thereof; an elevation portion coextensive with the predetermined lateral distance, located intermediate the gripping and engagement portions and positioned at a predefined gripping angle relative to the gripping portion and at a predetermined engagement angle relative to the engagement portion; wherein the linear member of the engagement portion transitions into the engagement extent along the distally extending transition portion, wherein the predetermined length is about 1" to about 1.5", with the transition portion having a predetermined acute transition angle of about 45°±5° relative to the linear member of the engagement portion, with the engagement extent located at a distalmost portion of the transition portion and extending distally from the transition portion, wherein the engagement extent is configured and dimensioned as a U-shaped member for engaging a component of an S-cam braking mechanism, wherein the component comprises one of a return spring shaft, an adjustment nut of a slack adjuster, one or more brake rollers, one or more brake shoes, one or more brake drums or one or more locking clips, wherein the gripping angle is provided in a range from about 75° to about 90° , wherein the engagement angle is provided in a range from about 75° to about 105° and wherein the U-shaped member comprises a forked head having a bridge section that is coextensive with the thickness of the elongate member and from which a pair of tines depend generally in parallel relative to one another, such that engagement of the component at the engagement extent facilitates pivotable and rotational movement of the brake tool.

20. A method for servicing an S-cam braking mechanism, which comprises:

engaging a component of an S-cam braking mechanism with the brake tool according to claim 19; and applying pressure to the gripping portion of the brake tool during the engaging step to facilitate removal or insertion of the component relative to the braking mechanism.

* * * * *